US007566017B2

(12) United States Patent
Latchireddi

(10) Patent No.: US 7,566,017 B2
(45) Date of Patent: Jul. 28, 2009

(54) APPARATUS FOR DISCHARGING MATERIAL FROM A MILL

(75) Inventor: Sanjeeva R. Latchireddi, Salt Lake City, UT (US)

(73) Assignee: Outotec Oyj, Espoo (FI)

( * ) Notice: Subject to any disclaimer, the term of this patent is extended or adjusted under 35 U.S.C. 154(b) by 593 days.

(21) Appl. No.: 11/334,179

(22) Filed: Jan. 17, 2006

(65) Prior Publication Data

US 2006/0283993 A1 Dec. 21, 2006

Related U.S. Application Data

(60) Provisional application No. 60/691,989, filed on Jun. 17, 2005.

(51) Int. Cl.
*B02C 17/14* (2006.01)

(52) U.S. Cl. ..... 241/183; 241/284; 241/300

(58) Field of Classification Search ..... 241/182, 241/183, 284, 300

See application file for complete search history.

(56) References Cited

U.S. PATENT DOCUMENTS 3,804,346 A * 4/1974 Norman ..... 241/182
4,323,199 A * 4/1982 Jardine et al. ..... 241/284
4,406,417 A * 9/1983 Jardine et al. ..... 241/284

FOREIGN PATENT DOCUMENTS

WO 98/01226 1/1998

* cited by examiner

*Primary Examiner*—Bena Miller
(74) *Attorney, Agent, or Firm*—Smith-Hill & Bedell, P.C.

(57) ABSTRACT

A pulp lifter for installation in a grinding mill has a leading edge and a trailing edge with respect to rotation of the mill and comprises a first wall bounding an interior space and a second wall dividing the interior space into first and second sections. The first wall includes a leading edge wall formed with an inlet opening providing access to the second section and an inner edge wall formed with an outlet opening for discharge of slurry from the second section. The second wall includes a guide that extends substantially from an outer end of the leading edge wall to a trailing end of the inner edge wall, and the first section of the interior space is open at the trailing edge of the pulp lifter.

19 Claims, 8 Drawing Sheets

A-A

APPARATUS FOR DISCHARGING MATERIAL FROM A MILL

CROSS REFERENCE TO RELATED APPLICATION

This application claims benefit of Provisional Application No. 60/691,989 filed Jun. 17, 2005, the entire disclosure of which is hereby incorporated by reference herein for all purposes.

BACKGROUND OF THE INVENTION

This invention relates to an apparatus for discharging material from a rotary mill that is used for grinding or comminution, and in which mill advantageously a grate and a pulp lifter are positioned upstream of a discharge opening in the proceeding direction of the material (i.e. the direction in which the material passes through the mill) and so installed in the interior of the mill that the grate and the pulp lifter are rotated with the rotation of the mill.

Pulp lifters in a mill for grinding or comminution of material transport the slurry passing through the apertures in the associated grate into the discharge opening of the mill. International Publication WO 98/01226 relates to a pulp lifter for a grate discharge mill. This pulp lifter comprises a plurality of chambers radially arranged to rotate against the downstream side of a vertical grate. A mill charge of mineral on the upstream side of the grate tumbles as the mill rotates. Water is fed to the mill and as the mineral is comminuted by the tumbling action, the fine particles and the water form a slurry in the interstices of the mineral. Some of the slurry passes through the apertures in the grate. Each chamber on the downstream side of the grate comprises a transitional compartment and a collection compartment. The transitional compartment has a wall that faces the grate, and this wall is formed with a plurality of apertures to enable the slurry to pass into the transitional compartment. During a portion of each rotation of the mill, each pulp lifter in turn passes against the mill charge on the upstream side of the grate and slurry passes through the grate to the transitional compartment. The pulp lifter is designed to enable slurry to pass from the transitional compartment to the collection compartment for subsequent discharge, but not back into the transitional compartment from the collection compartment. Thus, in the case of the practical implementation described in the WO publication, when the pulp lifter is at the bottom of its path of travel and slurry passes through the grate into the transitional compartment, the collection compartment is below the level of the transitional compartment.

The transitional compartment and the collection compartment disclosed in WO Publication WO 98/01226 form two substantially contiguous segments of the pulp lifter. Such segments can be separately divided into identical sections by a plate. The plates tilt slightly towards the grate side and are parallel with one another so that an area defined by one plate and one segment constitutes the transitional segment adjacent the grate, and an area defined by the other plate and the other segment constitutes the collection compartment, which is spaced from the face of the pulp lifter grate.

The pulp lifter described in International Publication WO 98/01226 is practical, when the mill is rotated at relatively low speed, i.e. below 75% of the critical speed of the mill. However, when the speed is increased higher, carryover of comminuted material in the collection compartment occurs and thus the effectiveness of grinding and comminution in the mill is decreased.

A disadvantage of many existing pulp lifters is that pebbles are able to accumulate in the pulp lifter and are recirculated as the mill rotates. The presence of a quantity of pebbles in the pulp lifter limits the space available for slurry and reduces the flow gradient through the grate, and may cause a slurry pool to be formed in the mill. In addition, many conventional pulp lifters are subject to disadvantage because of backflow from the pulp lifter through the grate. Thus, as soon as pulp lifter chamber fills with slurry, the flow gradient decreases and slurry may flow back through the grate as the pulp lifter rises.

The object of the present invention is to eliminate drawbacks of the prior art and to achieve a more effective apparatus for discharging material from a mill, which is used for grinding or comminution, even at the higher rotating speeds of the mill.

SUMMARY OF THE INVENTION

A preferred embodiment of the invention is apparatus for discharging material created in a mill during grinding or comminution so that the material to be discharged from the mill is guided through the apparatus. The apparatus is provided with two sections, which are connected to each other by at least one opening through which the material to be discharged from the mill passes. At least the second section in the proceeding direction is provided with at least one guide member, which directs the material towards the outlet of the second section and further to the outlet of the mill. By using the apparatus, mill speeds up to 90% of the critical speed of the mill are possible to utilize.

The opening between the two sections of the apparatus is the outlet of the first section in the proceeding direction of the material and simultaneously the inlet for the second section of the apparatus. The first section of the apparatus in the proceeding direction of the material is further provided with at least one opening for the inlet of the material and, respectively, the second section of the apparatus is provided with at least one opening for the outlet of the material to be discharged. The apparatus is preferably attached to a framework installed inside the mill. The framework is supported to the body of the mill, and the framework is positioned close to the discharge end of the mill. The apparatus extends radially inward from the internal surface of the wall of the mill over at least 30% of the length of the internal diameter of the mill. One first section and one second section together cover practically only one sector of the mill. Therefore, when the apparatus is installed in a mill, the mill may include altogether 8 to 40 units, depending on the mill size (diameter), of the apparatus, which units are separately attached to the framework of the mill.

The apparatus is preferably made of a single structural piece that is installed as a single unit in the mill but the apparatus may alternatively be made of at least two separate structural pieces. For instance, the first section and the second section may be made of separate structural pieces which are mechanically attached when they are installed in the mill. The structural material of the apparatus is preferably metal, which is covered by rubber.

The apparatus is installed in the mill so that the first section of the apparatus in the proceeding direction of the material is at least partly below the charge of material on the upstream side of the grate. In this condition, some of the material to be discharged from the mill passes into the first section through the holes in the grate and through the inlet opening of the first section. As the rotation of the mill continues, the first section is lifted and the material to be discharged flows downwards through the opening between the two sections and further into the second section. The guide member of the second section directs the material towards the outlet of the mill positioned in the center part of the mill. The guide member prevents the material from proceeding along the wall of the mill and thus prevents, or at least reduces, carryover of comminuted material.

BRIEF DESCRIPTION OF THE DRAWINGS

The invention is described in more detail in the following with reference to the drawings in which.

DETAILED DESCRIPTION

Figure 2:
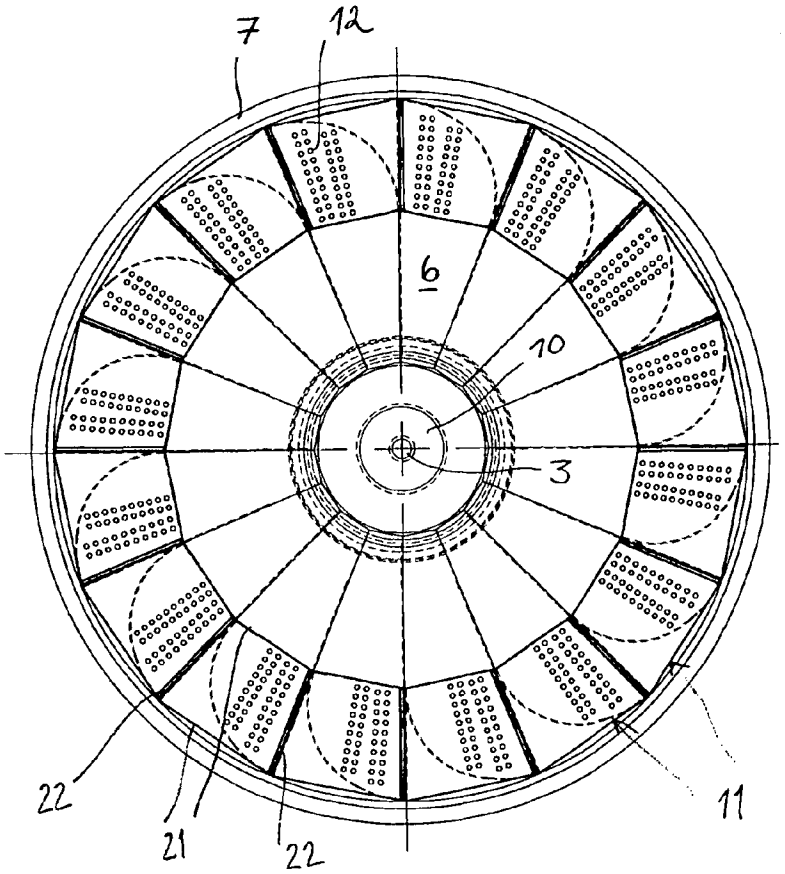
FIG. 2 shows the embodiment of FIG. 1 along the line A-A as a schematic side view.
Figure 1:
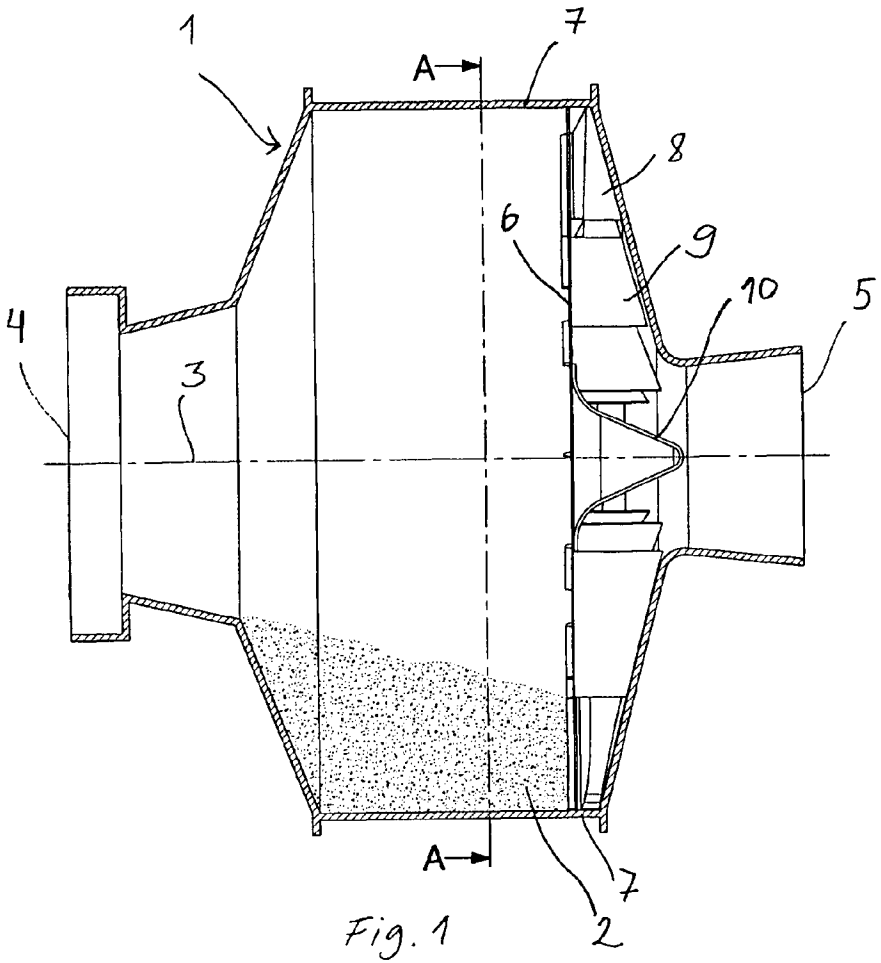
FIG. 1 shows a mill structure provided with apparatus embodying the invention as a partly cut schematic side view.

FIGS. 1 and 2 show a rotary grinding mill 1 that contains material 2 to be ground therein with aid of grinding media. The mill 1 is arranged to rotate around a rotation axis 3. The mill is supported via supporting means (not shown) to a mechanical ground. The material 2 to be ground in the mill is fed into a grinding zone of the mill 1 through an inlet 4. Water is advantageously also fed into the mill 1 in order to create a wet grinding in the mill 1. Between the grinding zone and the discharge opening 5 of the mill 1, a framework 6 is installed inside the mill 1 and supported to the body 7 of the mill 1. The framework 6 is a supporting member for a pulp lifter assembly that comprises guide members 8, 9 and a discharge cone 10. The pulp lifter assembly directs the ground material from the grinding zone to the discharge opening 5 of the mill 1. As illustrated in FIG. 2, the pulp lifter assembly comprises several sequential pulp lifters 11. Each pulp lifter 11 is attached to a grate or screen 12 having holes 13 through which the ground material 2 passes and enters a slurry pocket of the pulp lifter. As illustrated in FIG. 1, at least one pulp lifter 11 is at least partly immersed into the material 2 at a time during the operation of the mill 1. The pulp lifter 11 has a substantially rectangular or trapezoidal external shape so that two external sides or edges 21 of the pulp lifter 11 are essentially parallel and two other external sides or edges 22 are convergent to each other. The pulp lifter 11 is installed in the mill 1 so that the longer external side of the two parallel sides 21 is close to the body 7 of the mill 1.

Figure 5:
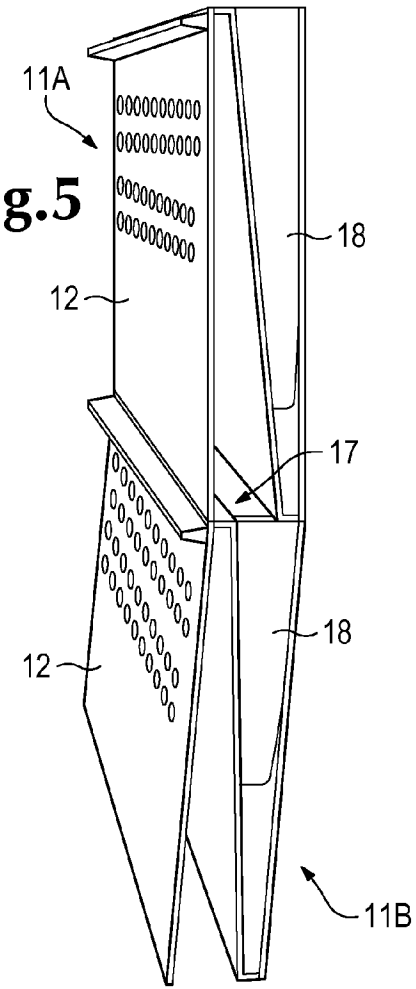
FIG. 5 shows the embodiment of FIG. 3 as a schematic side view.
Figure 4:
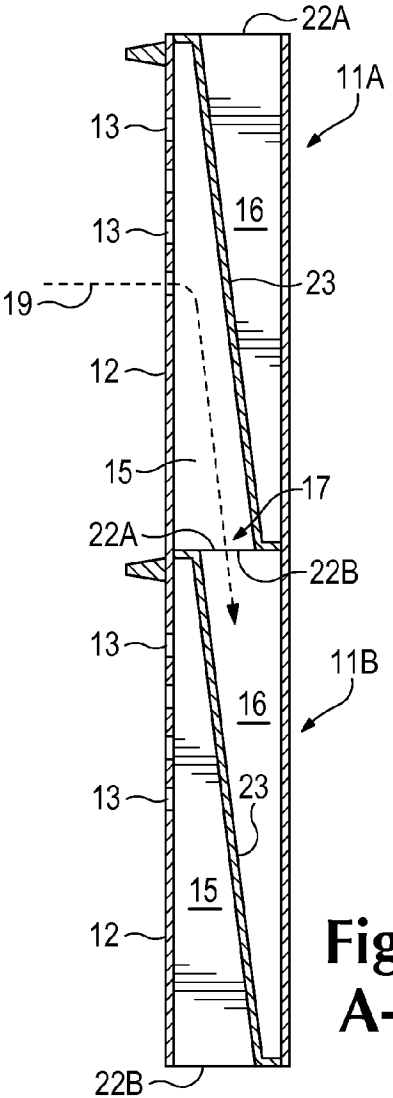
FIG. 4 shows the embodiment of FIG. 3 along the line B-B.
Figure 3:
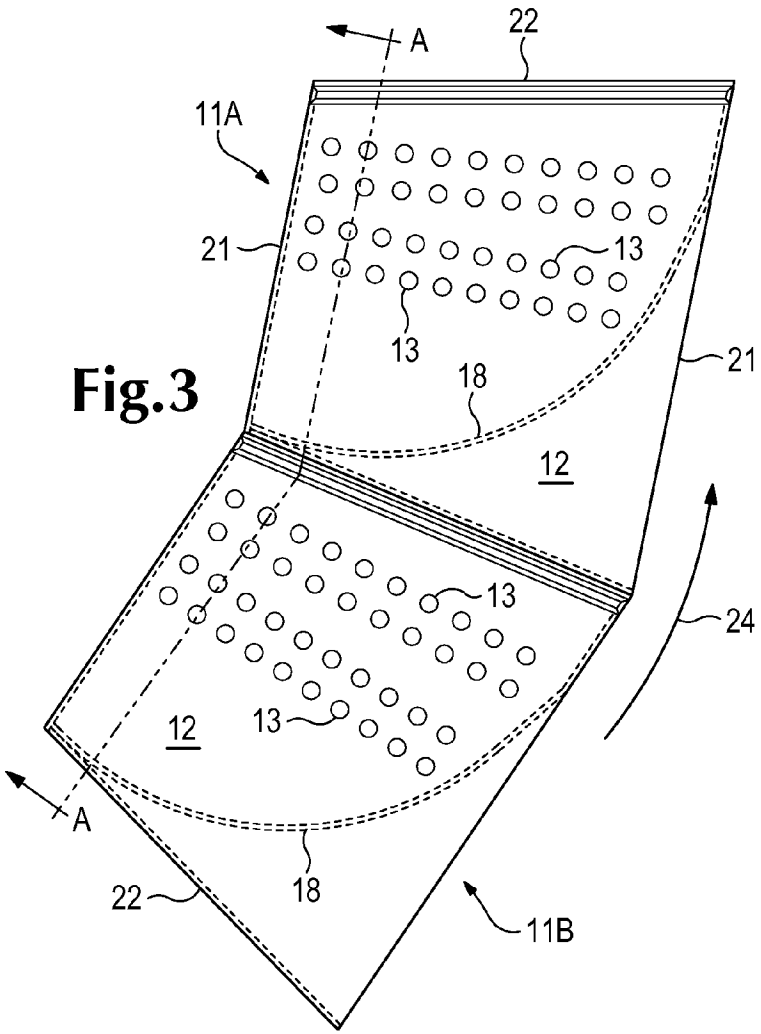
FIG. 3 shows two units of the apparatus as a schematic front view.

FIGS. 3 to 5 illustrate two pulp lifters 11A, 11B partially connected to each other. The pulp lifters shown in FIGS. 3-5 are similar to the embodiment shown in FIGS. 1 and 2. Each pulp lifter 11 has a first section 15 and a second section 16 separated by a wall 23. A grate or screen 12 with screening holes 13 is installed in front of the first section 15 of the pulp lifter 11 in the proceeding direction 19 of the material. Between the first section 15 of the pulp lifter 11B and the second section 16 of the pulp lifter 11A there is an opening 17. The second section 16 of each pulp lifter 11 is provided with a guide member 18, which extends from a point in the vicinity of the radially outer end of the leading edge 22 of the pulp lifter (with respect to the direction of rotation 24 of the mill) to a point in the vicinity of the radially inner end of the trailing edge 22 of the pulp lifter. As shown in the drawings, the guide member is constructed so that at least the part starting from the inlet of the second section is curved over at least 25% of the total length of the guide member. The outer end of the guide member (or the leading end in the direction of rotation of the mill) is directed tangentially of the mill whereas the inner or trailing end is directed essentially towards the rotating axis 3 of the mill 1.

During the operation of the mill 1, the mill 1 is rotated around its rotation axis 3 and the pulp lifters 11 are one after another immersed into the ground or comminuted material 2. While a given pulp lifter (such as the pulp lifter 11A) is immersed, some of the material 2 flows through the sieve or screen 12 into the first section 15 of the pulp lifter 11A. As the mill 1 continues to rotate, the first section 15 is step by step lifted from its immersed state, and the material in the first section 15 of the pulp lifter 11A flows downward into the second section 16 of the pulp lifter 11B through the opening 17. Owing to the guide member 18 in the second section 16 of the pulp lifter 11B the material flow is directed towards the center of the mill 1 and further by means of the guide members 8, 9 and 10 into the discharge opening 5 of the mill 1 and to the further processing of the material 2.

As the pulp lifter 11A rises, material that is in the radially outer region of the first section 15 flows downwards (see the arrow 19 in FIG. 4) into the second section 16 of the pulp lifter 11B through the opening 17 and is directed towards the central axis of the mill by the guide member. As the pulp lifters continue to rise, the material in the section 16 of the pulp lifter 11B is further directed towards the central axis and is discharged from the pulp lifter onto the guide members 8 and 9, which direct the material onto the cone 10. The material is unable to accumulate or collect in the outer lower corner region of the section 16.

The mill shown in FIGS. 1-6 rotates in the counter clockwise direction as seen in FIG. 2. Let us consider the situation where the pulp lifter 11A is at the 6 o'clock position (directly below the axis of rotation of the mill). In this case, several holes 13 in the grate 12 are immersed in the slurry and slurry enters the first section 15 of the pulp lifter 11A. Slurry also flows through the opening 17 into the second section 16 of the pulp lifter 11B, but cannot enter the lower rear (outer trailing) corner region of the second section because that region is blocked by the guide member 18. As the mill rotates from the 6 o'clock position towards the 3 o'clock position, the orientation of the pulp lifter 11A changes and some of the holes in the forward rows are exposed above the slurry while at least the radially outermost hole of the trailing row remains immersed. Since the slurry on the upstream side of the grate and the slurry in the first section 15 are in communication, pressure equilibrium between the upstream side of the grate and the first section is attained if the slurry in the first section of the pulp lifter flows downwards as the pulp lifter 11A rises, so that the free surface of the slurry in the pulp lifter tends to remain always lower than the free surface of the slurry on the upstream side of the grate keeping the flow gradient across the grate. In case the mill is fed more than the designed capacity of these pulp lifters, there is a possibility that some slurry will flow back out of the first section to the upstream side of the grate, but because the opening 17 is much larger than the holes 13 the major effect will be that the equilibrating flow will pass through the opening 17 into the second section 16 of the pulp lifter 11B. Further, because of the curved shape of the guide member, the lowest point in the available space in the second section 16 of the pulp lifter 11B, i.e. the space that is not blocked by the guide member 18, will move radially inwards, towards the central axis of the mill, as the mill rotates from the 6 o'clock position towards the 3 o'clock position instead of remaining in the lower outer corner of the second section. Depending on the depth of the slurry on the upstream side of the grate, some of the slurry in the second section may overflow the radially inner end of the guide member 18 and move towards the guide cone 10. In any event, when the pulp lifter 11A reaches the 3 o'clock position substantially all the slurry will have passed into the second section of the pulp lifter 11B and much of the slurry will have moved from the pulp lifter 11B towards the guide cone and as it reaches the 12 o'clock position all the slurry will fall onto the guide cone 10.

Figure 6:
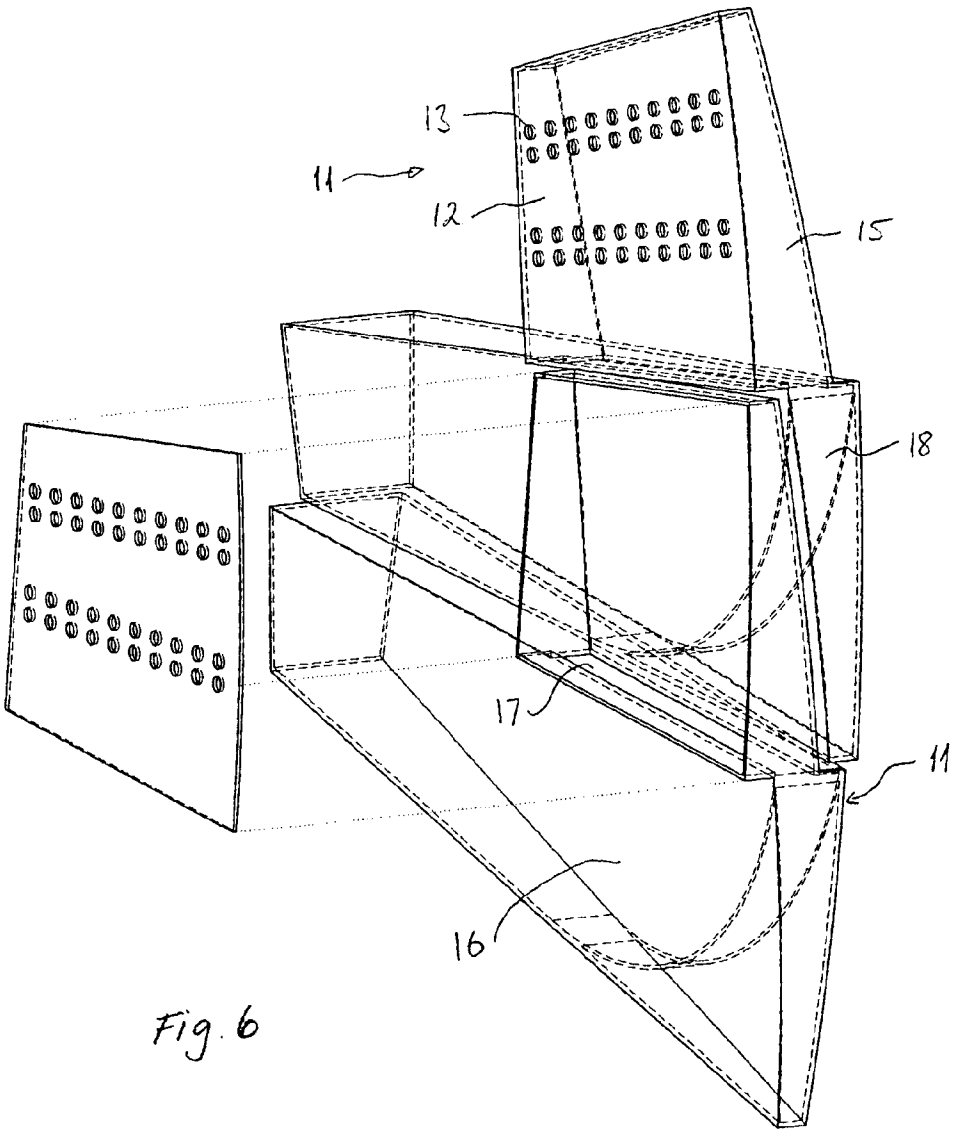
FIG. 6 is an enlarged partial perspective view of two pulp lifters embodying the present invention.

FIG. 6 illustrates a modification of the pulp lifter shown in FIGS. 3-5. In FIG. 6, the two sections 15, 16 of each pulp lifter are circumferentially adjacent each other, instead of being circumferentially overlapping. Thus, each pulp lifter has a leading section 15 and a trailing section 16 with respect to the direction of rotation of the mill, and the two sections are in communication via the opening 17. The pulp lifters are installed in shingled fashion, with the leading section of a given pulp lifter overlapping the trailing section of the pulp lifter that is forward of the given pulp lifter in the direction of rotation of the mill. The section 16 of each pulp lifter is connected to guide members 9 forming a duct that extends radially of the mill.

Figure 7:
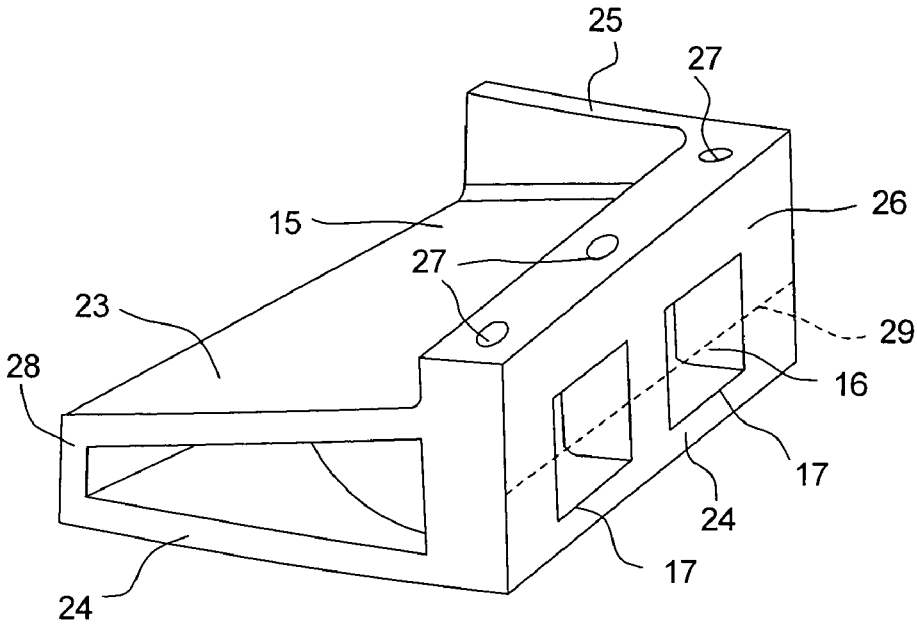
FIG. 7 is a perspective view of a third pulp lifter embodying the present invention.

FIG. 7 illustrates a practical implementation of the pulp lifter that is shown more schematically in FIGS. 3-5. Viewing the pulp lifter along the axis of rotation of the mill, the pulp lifter has a continuous back wall 24, an inner edge wall 25 formed with a discharge opening (not shown), and a leading edge wall 26. The pulp lifter is open at its front side. An intermediate wall 23 is spaced from the back wall 24 and is connected to the back wall by the guide 18. The guide 18 and the intermediate wall 23 separate the first section 15 of the pulp lifter from the second section 16. The leading edge wall 26 is formed with transfer openings 17. The grate (not shown) is attached to the pulp lifter using fasteners that engage holes 27 in the leading edge wall. When multiple lifters are installed in a grinding mill, the first section 15 of the leading pulp lifter communicates with the second section 16 of the following pulp lifter through the transfer openings 17 in the leading edge wall 26 of the following pulp lifter. In operation, slurry enters the first section 15 of a pulp lifter through the holes in the grate as the lifter passes through the 6 o'clock position. As the pulp lifter rotates towards the 3 o'clock position, the pulp lifter rises relative to the following pulp lifter and slurry in the first section 15 of the leading pulp lifter flows through the transfer openings 17 into the second section 16 of the following pulp lifter. As the pulp lifters continue to rotate, the slurry in the second section of the following pulp lifter flows along the guide 18 and flows through the opening in the inner edge wall 25 towards the cone 10, as explained above. The configuration of the guide 18 is somewhat different in FIG. 7 from FIGS. 3-5, in that the radially outer end of the guide is not tangential to the periphery of the mill, but the essential function of the guide, preventing comminuted material from remaining against the wall of the mill as the pulp lifter rotates from the 6 o'clock position towards the 3 o'clock position, is the same.

Figure 8:
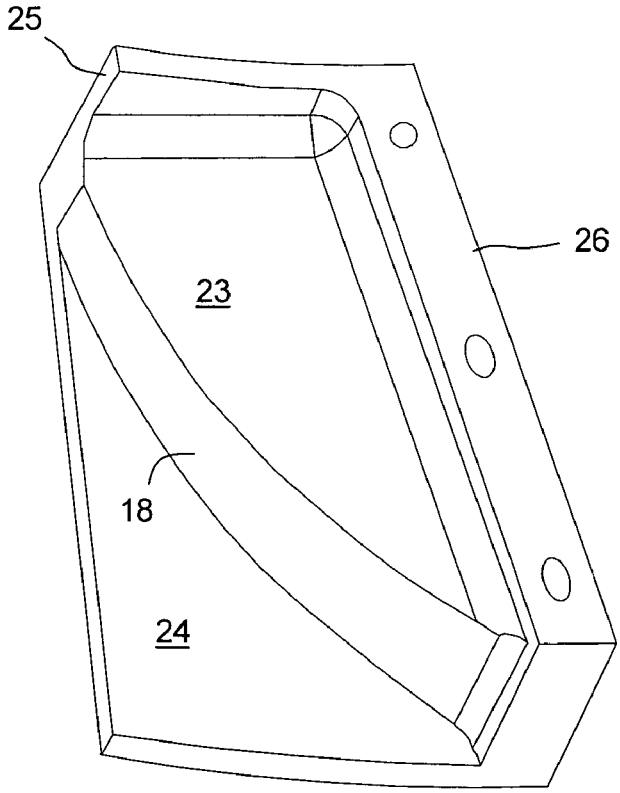
FIG. 8 is a perspective view of a fourth pulp lifter embodying the present invention.
Figure 9:
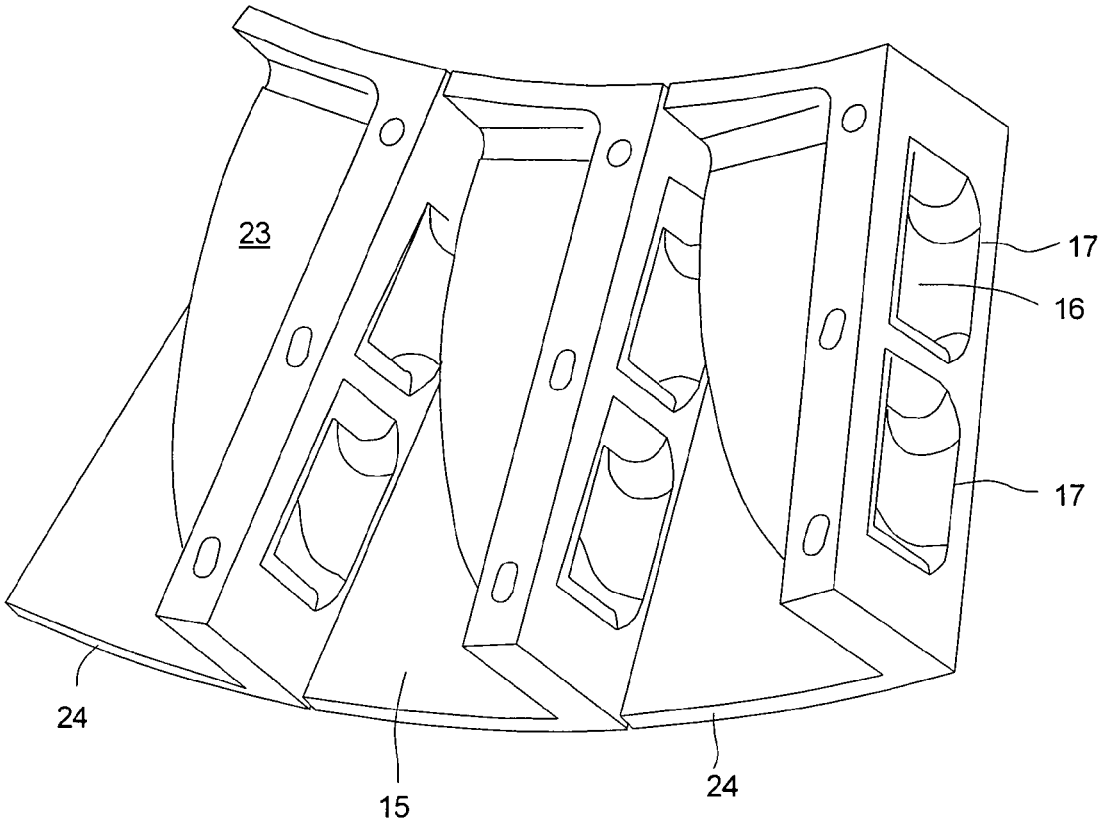
FIG. 9 is a perspective view illustrating the manner in which the pulp lifter shown in FIG. 8 cooperates with other pulp lifters of similar structure.

FIGS. 8 and 9 illustrate another pulp lifter embodying the present invention. The pulp lifter shown in FIGS. 8 and 9 is similar to that shown in FIG. 7 except that the intermediate wall 23 is not coextensive with the back wall 24 but extends only over the second section 16 of the pulp lifter. Thus, the space between the back wall and the intermediate wall that is not available to slurry in the lifter shown in FIG. 7 because of the guide 18 is part of the first section in the lifter shown in FIGS. 8 and 9. Consequently, the area available for transfer of slurry from the first section 15 to the second section 16 via the transfer opening 17 is greater in the case of FIGS. 8 and 9 than in the case of FIG. 7. In addition, it will be appreciated that when multiple pulp lifters as shown in FIG. 7 are installed, the trailing edge wall 28 of the leading pulp lifter partially blocks the transfer openings 17 of the following pulp lifter, and only the portion forward of the dashed line 29 shown in FIG. 7 is available for flow of slurry. In the case of FIGS. 8 and 9, for a pulp lifter of similar size the transfer openings 17 of the following pulp lifter are of greater effective area because they are not partially blocked by the leading pulp lifter.

The use of the guide 18 in the pulp lifters shown in the drawings is advantageous relative to hitherto conventional pulp lifters for several reasons. First, the transfer of slurry from the first section 15 to the second section 16 through the transfer opening prevents flowback through the grate from the second section as the pulp lifter rises from the 6 o'clock position to the 3 o'clock position. Second, by preventing accumulation of material in the outer trailing area of the pulp lifter, the guide 18 ensures that there is minimal carryover of pebbles and slurry as the mill rotates.

Figure 10A:
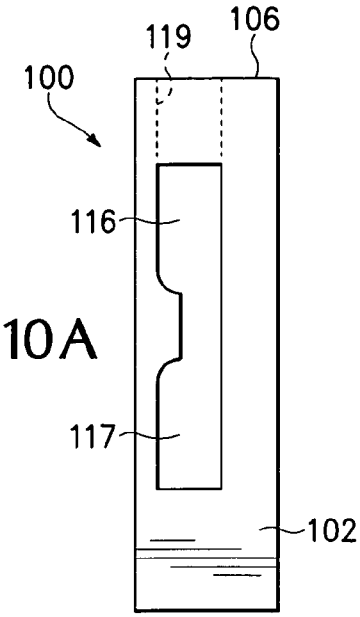
FIG. 10A is a view of the component shown in FIG. 10 taken on the line 10A-10A of FIG. 10, FIGS. 11-13 are perspective views of the fifth pulp lifter structure at different stages of assembly.
Figure 10:
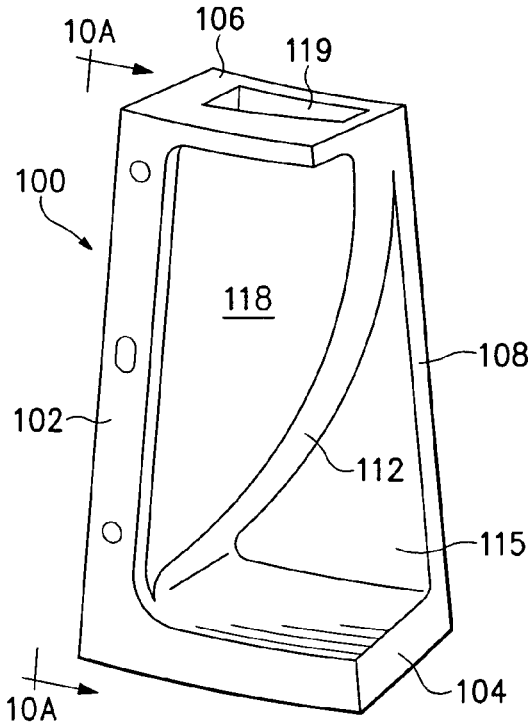
FIG. 10 is a perspective view of a component of a fifth pulp lifter structure embodying the present invention.

FIGS. 10-13 illustrate a further pulp lifter structure. The pulp lifter structure shown in FIGS. 10-13 is attached to the axially downstream wall of the mill, which rotates in the clockwise direction seen in FIGS. 10-13, and comprises an outer pulp lifter 100 (FIGS. 10 and 10A) having a leading wall 102, a radially outer wall 104, a radially inner wall 106, an axially downstream wall 108, and an intermediate wall 110 that is generally parallel to and spaced from the axially downstream wall 108 and is connected to the axially downstream wall by a curved guide 112. The walls 102-110 and the guide 112 define an inlet chamber 115 that is open towards the viewer and to the right of the figure. The leading wall 102 is formed with a transfer opening 117 (FIG. 10A) that provides access to an outlet chamber 116 defined between the intermediate wall 110 and the axially downstream wall 108 and bounded by the guide 112. The radially inner wall is formed with an outlet opening 119. Multiple outer pulp lifters as shown in FIGS. 10 and 10A are attached to the axially downstream wall of the mill in an annular array. The inlet chamber 115 of a leading pulp lifter communicates with the outlet chamber 116 of a following pulp lifter via the transfer opening 117 in the wall 102 of the following pulp lifter.

Figure 11:
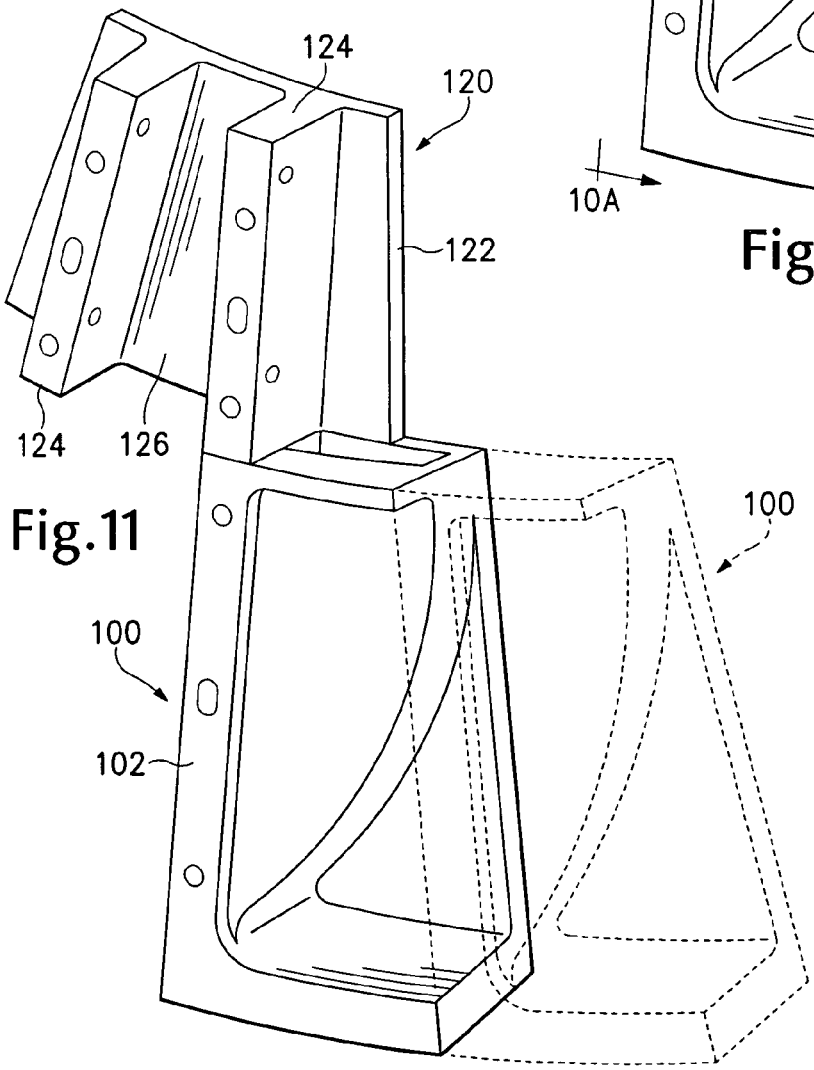
Figure 12:
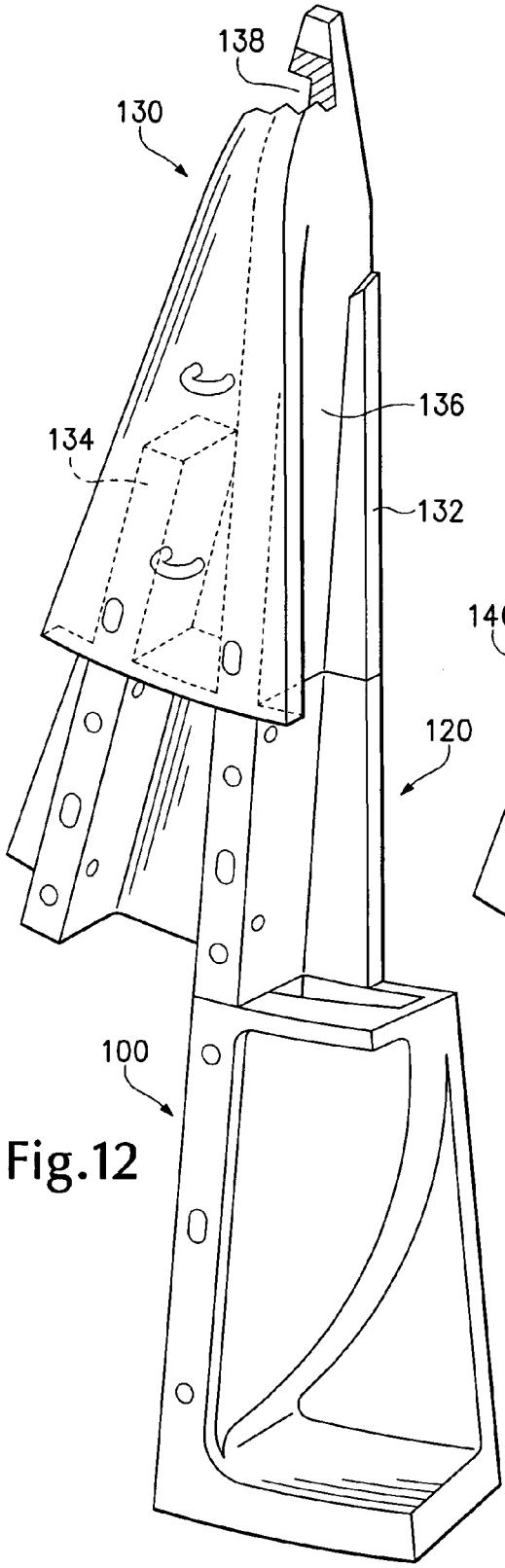

Referring to FIG. 11, inner pulp lifters 120 are attached to the axially downstream wall of the mill in an annular array inward of the outer pulp lifters 100. There is one inner pulp lifter 120 for each two adjacent outer pulp lifters 100. Each inner pulp lifter 120 comprises an axially downstream wall 122 and two radial walls 124, the radial walls 124 being aligned respectively with the leading walls 102 of two adjacent outer pulp lifters 100. Each two adjacent radial walls 124 of an inner pulp lifter define a channel 126 into which the outlet opening of an outer pulp lifter debouches. Similarly, the following radial wall 124 of a leading inner pulp lifter and the leading radial wall of a following inner pulp lifter define a channel into which the outlet opening 119 of an outer pulp lifter debouches.

The pulp lifter structure further comprises dischargers 130 (FIGS. 12 and 13) that are attached to the axially downstream wall of the mill in an annular array inward of the inner pulp lifters 120. Each discharger has an axially downstream wall 132 and two radial walls 134 and 136 projecting from the wall 132. Each discharger defines a discharge channel between its two radial walls 134, 136, and each two adjacent dischargers define a discharge channel between the following wall 136 of the leading discharger and the leading wall 134 of the following discharger. It will be noted from FIG. 12 that the leading wall 134 is radially shorter than the following wall 136. The channel defined between the two walls 134, 136 of the discharger, and the channel defined between the wall 134 of the leading discharger and the wall 136 of the following discharger, open into a discharge space defined between the wall 136 of the leading discharger and the wall 136 of the following discharger. The axially downstream wall 132 of the following discharger is formed with an opening 138 that communicates with the discharge space defined between the following wall 136 of the following discharger and the wall 136 of the leading discharger.

Figure 13:
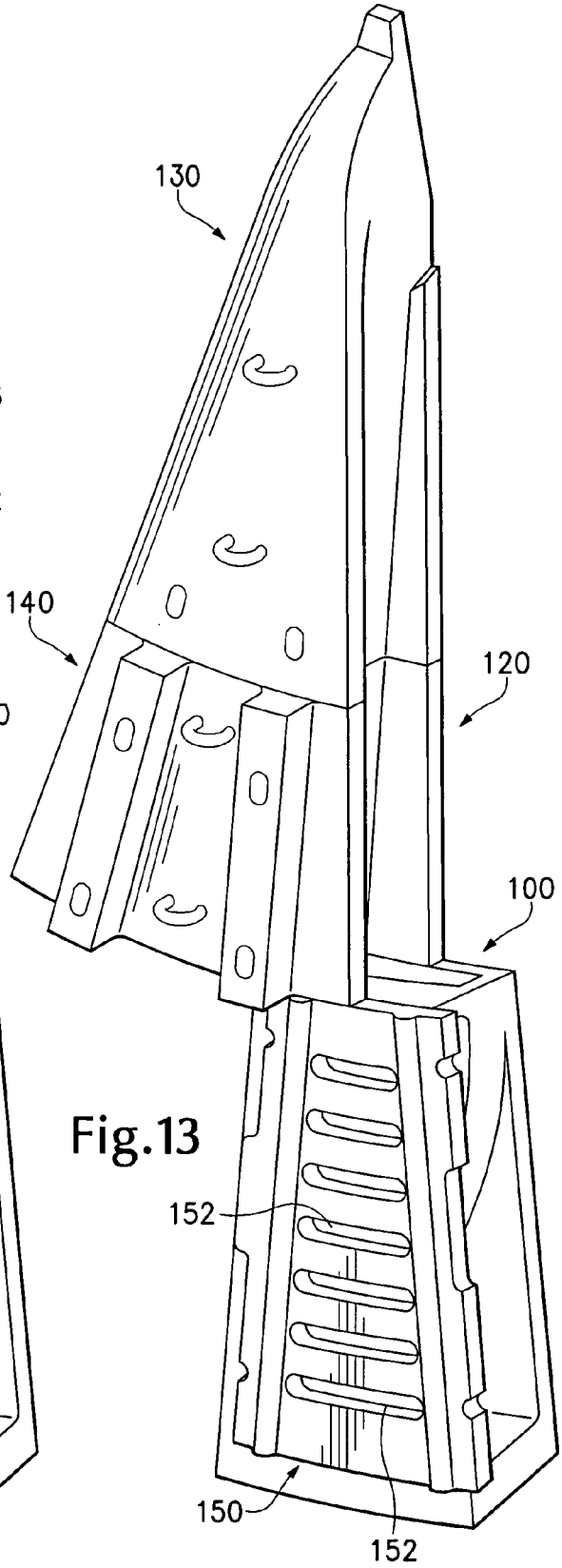

Referring to FIG. 13, a center liner 140 is attached to the inner pulp lifter 120 and a grate plate 150 is attached to the outer pulp lifter 100.

In operation, as the mill rotates and an outer pulp lifter approaches the 6 o'clock position, slurry (which may include pebbles) enters the inlet chamber through the openings 152 in the grate plate. As the outer pulp lifter moves towards the 3 o'clock position, the outer pulp lifter rises relative to the following pulp lifter and slurry in the inlet chamber 115 of the leading pulp lifter flows through the transfer opening 117 in the leading wall of the following outer pulp lifter and enters the outlet chamber 116 of that pulp lifter. As the mill continues to rotate, the slurry in the outlet chamber of the outer pulp lifter flows along the guide 112 and flows through the opening 119 in the radially inner wall 106 into the channel 126 of the inner pulp lifter, and ultimately into the discharger 130. Most of the slurry leaves the discharger through the opening 138 and moves towards the guide cone (not shown).

Figure 14:
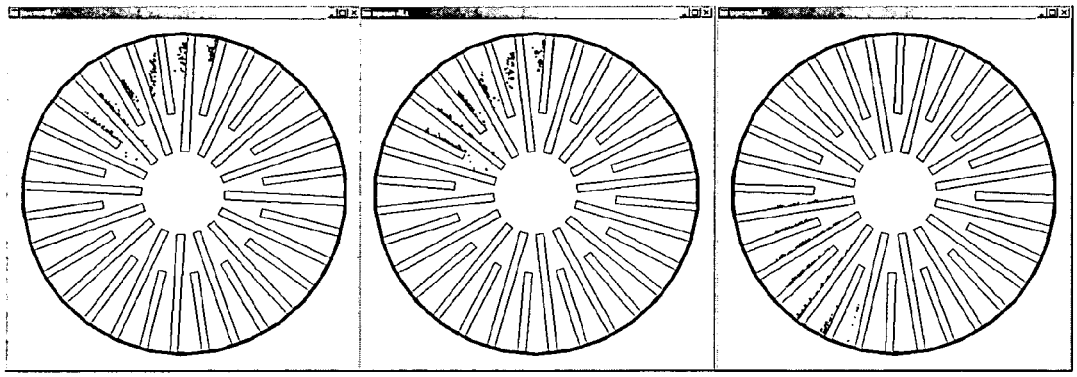
FIGS. 14 and 15 show how carryover of pebbles in a grinding mill embodying the present invention is reduced compared to a conventional grinding mill.
Figure 15:
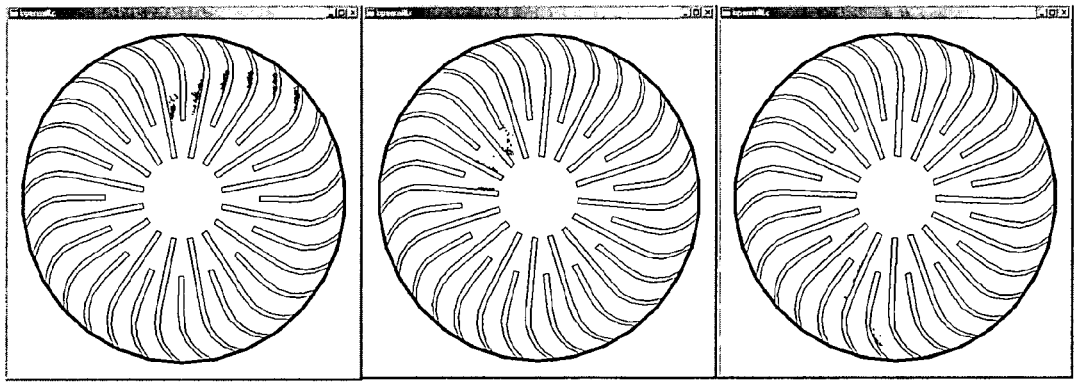

FIGS. 14 and 15 show the results of Discrete Element Method (DEM) computer simulations of the operation of a conventional pulp lifter (FIG. 14) having a radial trailing edge wall and a pulp lifter embodying the invention (FIG. 15) having a curved guide. FIG. 14 shows that in the event that the pulp lifter has a radial trailing edge wall, many pebbles do not move from the pulp lifter towards the cone 10 until the pulp lifter arrives almost at the 12 o'clock position, and there is then insufficient time for all the pebbles to move out of the pulp lifter before the pulp lifter reaches the 10 o'clock position, at which friction prevents the pebbles from moving farther towards the cone. Consequently, a steady-state charge of pebbles remains in the pulp lifter, reducing the useable volume of the pulp lifter and possibly creating a slurry pool on the upstream side of the grate. In the case of the mill shown in FIG. 15, with pulp lifters having the curved guide 18 (or 112), the pebbles start to move towards the cone before the pulp lifter reaches the 1 o'clock position. There is a greater probability that the pebbles will be discharged from the pulp lifter by the time the pulp lifter reaches the 10 o'clock position, so the likelihood of a steady state charge of pebbles remaining in the pulp lifter is reduced. It has been shown that whereas in the case of the pulp lifter shown in FIG. 14 the efficiency of pebble removal in one revolution may be as low as about 31%, in the case of the pulp lifter shown in FIG. 15 the efficiency of pebble removal in one revolution may be as high as about 89% which can be improved to 100% by optimizing the curvature design.

It will be appreciated that the invention is not restricted to the particular embodiment that has been described, and that variations may be made therein without departing from the scope of the invention as defined in the appended claims and equivalents thereof. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. If the word "comprises" or "includes," or a derivative of either of these words is used in this specification, including the claims, it is used in an inclusive, not exclusive or exhaustive, sense. Thus, for example, a statement that a component comprises first and second elements is not intended to exclude the possibility of the component including one or more additional elements.

The invention claimed is:

1. A pulp lifter for installation in a grinding mill downstream of a grate formed with apertures that allow slurry to pass to the pulp lifter for removal from the mill by the pulp lifter, the pulp lifter having a leading edge and a trailing edge with respect to rotation of the mill and comprising:

a first wall means bounding an interior space, and a second wall means dividing the interior space into first and second sections, wherein the first wall means includes a leading edge wall formed with an inlet opening providing access to the second section and an inner edge wall formed with an outlet opening for discharge of slurry from the second section, the second wall means includes a guide that extends substantially from an outer end of the leading edge wall to a trailing end of the inner edge wall, and the first section of said interior space is open at the trailing edge of the pulp lifter.

2. A pulp lifter according to claim 1, wherein the guide is concave towards the leading edge wall of the first wall means.

3. A pulp lifter according to claim 2, wherein the guide is curved.

4. A pulp lifter according to claim 2, wherein the guide has an outer segment at an acute angle to an outer edge of the pulp lifter and has an inner segment at an acute angle to the trailing edge of the pulp lifter.

5. A pulp lifter according to claim 4, wherein the guide is curved and is concave towards the leading edge wall of the first wall means.

6. A pulp lifter according to claim 1, wherein the first wall means includes a back wall, the second wall means includes an intermediate wall in spaced confronting relationship with the back wall, and the guide is disposed substantially perpendicular to the back wall and connects the back wall to the intermediate wall.

7. A pulp lifter according to claim 6, wherein the intermediate wall is substantially coextensive with the back wall, whereby the intermediate wall and the guide define a chamber at a trailing side of the guide, said chamber being isolated from both the first section and the second section of the interior space.

8. A pulp lifter according to claim 6, wherein the intermediate wall has a trailing edge boundary that substantially coincides with a trailing side of the guide, whereby the first section of the interior space is bounded by the intermediate wall, the guide and the back wall.

9. A grinding mill including a grate formed with apertures that allow slurry to pass through the grate from an upstream side of the grate to a downstream side of the grate, and a plurality of pulp lifters installed on the downstream side of the grate and distributed about an axis of rotation of the mill for removing slurry from the mill, each pulp lifter having a leading edge and a trailing edge with respect to rotation of the mill, each two successive pulp lifters about the axis of rotation of the mill being respectively a leading pulp lifter and a trailing pulp lifter with respect to rotation of the mill, and each pulp lifter comprising:

a first wall means bounding an interior space, and a second wall means dividing the interior space into first and second sections, and wherein the first wall means includes a leading edge wall formed with an inlet opening providing access to the second section and an inner edge wall formed with an outlet opening for discharge of slurry from the second section, the second wall means includes a guide that extends substantially from an outer end of the leading edge wall to a trailing end of the inner edge wall, and the first section of a leading pulp lifter is in communication with the second section of its trailing pulp lifter by way of the opening in the leading edge wall of the trailing pulp lifter.

10. A grinding mill according to claim 9, wherein the guide has an outer segment at an acute angle to an outer edge of the pulp lifter and has an inner segment at an acute angle to the trailing edge of the pulp lifter.

11. A grinding mill according to claim 9, wherein the first wall means includes a back wall, the second wall means includes an intermediate wall in spaced confronting relationship with the back wall, and the guide is disposed substantially perpendicular to the back wall and connects the back wall to the intermediate wall.

12. A grinding mill according to claim 11, wherein the intermediate wall is substantially coextensive with the back wall, whereby the intermediate wall and the guide define a chamber at a trailing side of the guide, said chamber being isolated from both the first section and the second section of the interior space.

13. A grinding mill according to claim 11, wherein the intermediate wall has a trailing edge boundary that substantially coincides with a trailing side of the guide, whereby the first section of the interior space is bounded by the intermediate wall, the guide and the back wall.

14. A grinding mill according to claim 9, wherein the first wall means includes a back wall and the interior space of the leading pulp lifter is bounded by the leading edge wall, the back wall and the inner edge wall of the leading pulp lifter, the leading edge wall of the trailing pulp lifter, and the grate.

15. A pulp lifter assembly, for installation in a grinding mill on a downstream side of a grate formed with apertures that allow slurry to pass through the grate from an upstream side of the grate to the downstream side of the grate, the pulp lifter assembly comprising a plurality of mutually adjacent pulp lifters each having a leading edge and a trailing edge, each two adjacent pulp lifters being respectively a leading pulp lifter and a trailing pulp lifter, and each pulp lifter comprising:

a first wall means bounding an interior space, and a second wall means dividing the interior space into first and second sections, and wherein the first wall means includes a leading edge wall formed with an inlet opening providing access to the second section and an inner edge wall formed with an outlet opening for discharge of slurry from the second section, the second wall means includes a guide that extends substantially from an outer end of the leading edge wall to a trailing end of the inner edge wall, and the first section of a leading pulp lifter is in communication with the second section of its trailing pulp lifter by way of the opening in the leading edge wall of the trailing pulp lifter.

16. A pulp lifter assembly according to claim 15, wherein the first wall means includes a back wall, the second wall means includes an intermediate wall in spaced confronting relationship with the back wall, and the guide is disposed substantially perpendicular to the back wall and connects the back wall to the intermediate wall.

17. A pulp lifter assembly according to claim 16, wherein the intermediate wall is substantially coextensive with the back wall, whereby the intermediate wall and the guide define a chamber at a trailing side of the guide, said chamber being isolated from both the first section and the second section of the interior space.

18. A pulp lifter assembly according to claim 16, wherein the intermediate wall has a trailing edge boundary that substantially coincides with a trailing side of the guide, whereby the first section of the interior space is bounded by the intermediate wall, the guide and the back wall.

19. A pulp lifter structure for installation in a grinding mill, the pulp lifter structure including:

an outer pulp lifter having a leading edge and a trailing edge with respect to rotation of the mill and comprising a first wall means bounding an interior space and a second wall means dividing the interior space into first and second sections, wherein the first wall means includes a leading edge wall formed with an inlet opening providing access to the second section and an inner edge wall formed with an outlet opening for discharge of slurry from the second section, the second wall means includes a guide that extends substantially from an outer end of the leading edge wall to a trailing end of an inner edge wall, and the first section of said interior space is open at the trailing edge of the pulp lifter, a grate formed with apertures for allowing slurry to pass to the pulp lifter for removal from the mill by the pulp lifter, an inner pulp lifter defining a channel for receiving slurry from the outlet opening of the outer pulp lifter and conveying the slurry radially inward relative to the mill, a discharger for receiving slurry from the channel of the inner pulp lifter and discharging the slurry from the pulp lifter.

* * * * *